United States Patent [19]

Ammann et al.

[11] 4,028,202

[45] June 7, 1977

[54] DIRECT ELECTROCHEMICAL RECOVERY OF COPPER FROM DILUTE AMMONIACAL SOLUTIONS

[75] Inventors: Paul R. Ammann, Boxford; Glenn M. Cook, Harvard; Charles Portal, Newton, all of Mass.

[73] Assignee: Kennecott Copper Corporation, New York, N.Y.

[22] Filed: Oct. 28, 1975

[21] Appl. No.: 626,114

Related U.S. Application Data

[63] Continuation-in-part of Ser. No. 596,458, July 16, 1975.

[52] U.S. Cl. ..... 204/106

[51] Int. Cl.[2] ..... C25C 1/12

[58] Field of Search ..... 204/106, 52

[56] References Cited

UNITED STATES PATENTS

| | | | |
|---|---|---|---|
| 883,961 | 4/1908 | Jumau | 204/106 |
| 1,001,466 | 8/1911 | Slaughter | 204/106 |

*Primary Examiner*—John H. Mack
*Assistant Examiner*—H. A. Feeley

[57] ABSTRACT

A process for the direct electrochemical recovery of copper values from dilute ammoniacal leach liquors.

17 Claims, 9 Drawing Figures

DIRECT ELECTROCHEMICAL RECOVERY OF COPPER FROM DILUTE AMMONIACAL SOLUTIONS

BACKGROUND OF THE INVENTION

This application is a continuation-in-part of copending application Ser. No. 596,458 filed July 16, 1975, entitled, "Direct Electrochemical Recovery of Copper from Dilute Acidic Solutions".

This invention is directed to a process for the electrochemical recovery of copper from dilute ammoniacal solutions of pregnant leach liquors using a porous high surface area cathode electrode. In the preferred embodiment the barren leach liquor is recycled to recover additional copper in treatment of copper containing materials.

It has long been known that copper can be recovered by leaching copper bearing ores or ore concentrates with an ammonia-ammonium salt leach solution. For example, see U.S. Pat. No. 1,843,808 where copper silicate ores are directly leached with an ammoniacal solvent. U.S. Pat. Nos. 2,727,818 and 2,727,819 describe the ammoniacal leaching of copper values from copper sulfide ores. Various leaching methods are also described by Allison Butts in "Copper-The Science and Technology of the Metal, Its Alloys and Compounds", Hafner Publishing Company, Inc., 1970, pp. 303, 316, and 332. More recently, manganese deep sea nodules have been leached with ammonia-ammonium salt leach solutions resulting in a copper containing ammoniacal solution. See U.S. Pat. Nos. 3,736,125; 3,753,686; 3,723,095; 3,734,715; 3,788,841; and 3,751,554. In U.S. Pat. No. 3,278,232, there is described an in-situ leaching process for recovery of copper values as a copper-ammonia complex.

One of the new generation of copper extraction plants went on line at Anaconda, Montana in September 1974 and is known as the Arbiter Process (Engineering and Mining Journal, Vol. 176, No. 6, June 1975). This process is based on a low-pressure leach of copper concentrates at a moderate temperature with an oxygen/ammonia/ammonium sulfate lixiviant system. In this process copper is solubilized as copper amine sulfate $[Cu(NH_3)_4SO_4]$. See South African Pat. No. 74/0,604, Oct. 25, 1974.

Yet another source of copper containing ammonium solutions results from the leaching of copper scrap sources with an ammonium-ammonium carbonate solution. For example, see U.S. Pat. No. 3,865,580.

Heretofore, various practices have been used to recover copper from pregnant ammoniacal leach solutions. These practices include solid ion exchange and liquid ion exchange (see Arbiter et al., South African Pat. No. 74/0,604). Copper is removed from the solid or liquid ion exchange medium with an acidic solution from which the copper can be electrowon by conventional means. It is also known that copper can be recovered from the copper containing ammonia-ammonium salt solutions by decomposition, precipitation etc. Various methods are then used to recover a high purity metal from these copper sources. See U.S. Pat. Nos. 3,647,423 and 3,681,055.

In accordance with the principle object of this invention, applicant's process is directed to the electrowinning of copper directly from ammoniacal leach solutions without any chemical or physical pretreatment. It is to be understood that the invention described herein has general applicability to the recovery of copper from any ammoniacal copper-bearing solution from any source. For the purposes of this disclosure, however, pregnant leach solutions will be described as having been obtained from the leaching of copper ores or concentrates as, presently contemplated, this is the best mode of practicing applicant's invention. It will be apparent from the description to follow that the process is subject of many modifications. Variations will become readily apparent to those versed in the art without departure from the scope of the invention. We do not regard such specific details as essential to the invention except insofar as they are expressed by way of limitation in the appended claims in which it is our intention to claim all novelty inherent in the invention as broadly as is permissable in view of the prior art.

There are many processes for the recovery of copper from copper containing materials, for example, the processes disclosed in U.S. Pat. Nos. 3,716,459; 3,657,101; 3,657,100; 3,464,904 and 3,459,646. These processes, however, are not capable of use or adoption in an overall integrated process as described herein. The prior art does not teach a process for the leaching of copper bearings material with an ammoniacal leach solution followed by direct electrowinning of the copper from the pregnant ammoniacal leach solution. Moreover, in accordance with the present invention the pregnant leach liquor preferably flows first through a cathode for the cathode reactions to take place and then flow by or through an anode for the anode reactions to take place with minimum or no back mixing which feature is also not taught in the prior art.

An object of this invention is direct electrochemical recovery of high grade copper from dilute ammoniacal solutions of pregnant leach liquors in a combination which utilizes the barren liquors for leaching copper bearing ores or ore concentrates. Further, an object of this invention is a combination which provides for recovering high-grade copper from ammoniacal leach solutions while providing in the total recovery scheme a suitable recycled stream for leaching additional copper values. Still further, an object of this invention is an electrochemical winning of copper from large volumes of dilute, pregnant liquors first via a high surface area porous cathode and then the recyle of the barren liquor with further treatment to replace the ammonia consumed in the electrolytic process and to recover additional copper values.

These generalized objects will be explained in further detail herein, while the invention itself will be defined by the claims.

SUMMARY OF THE INVENTION

The present invention pertains to the direct electrochemical recovery of copper from dilute ammoniacal solutions obtained from ammoniacal leaching copper bearing ores, ore concentrates, or copper bearing scrap materials. More particularly, the invention relates to a combination of process steps which provides for recovery of high-grade copper from these leach liquors while providing in the overall recovery scheme a suitable recycle stream for leaching additional copper values from the copper containing materials. Still further, the invention relates to the recovery of high-grade copper by electrowinning copper from dilute pregnant liquors containing metal contaminants using a high surface area porous cathode.

The barren effluent solution from the electrolytic cell is, with minimal further treatment, suitable for recycling and leaching additional copper values from the copper bearing materials.

The reactions that take place at the cathode and the reactions that take place at the anode are as follows:

CATHODE REACTIONS $$Cu(NH_3)_4^{+2} + e^- = Cu(NH_3)_2^+ + 2NH_3 \quad E^\circ_{1/2} = -0.542 \text{ Volts} \quad (1)$$
$$Cu(NH_3)_2^+ + e^- = Cu^\circ_{(s)} + 2NH_3 \quad E^\circ_{1/2} = -0.126 \text{ Volts} \quad (2)$$
$$Cu(NH_3)_4^{+2} + 2e^- = Cu^\circ_{(s)} + 4NH_3 \quad E^\circ_{1/2} = -0.334 \text{ Volts} \quad (3)$$
$$2Cu(NH_3)_4^{+2} + 2\,OH^- + 2e^- = Cu_2O_{(s)} + H_2O + 8NH_3 \quad E^\circ_{1/2} = -0.309 \text{ Volts} \quad (4)$$
$$2H_2O + 2e^- = H_{2(g)} + 2\,OH^- \quad E^\circ_{1/2} = -0.828 \text{ Volts} \quad (5)$$
$$NO_3^- + 2NH_4^+ + 2e^- = NO_2^- + 2NH_3 + H_2O \quad E^\circ_{1/2} = +0.286 \quad (6)$$

ANODE REACTIONS $$4OH^- = O_{2(g)} + 2H_2O + 4e^- \quad E^\circ_{1/2} = -0.401 \quad (7)$$

Side reactions such as the following may occur to a small extent.

$$NH_3 + 7\,OH^- = NO_2^- + 5H_2O + 6e^- \quad E^\circ_{1/2} = +0.161 \quad (8)$$
$$NH_4OH + 5\,OH^- = NO + 5\,H_2O + 5e^- \quad E^\circ_{1/2} = +0.102 \quad (9)$$

The overall electrochemical reaction observed for the cell is:

$$Cu(NH_3)_4^{+2} + 2OH^- = Cu^\circ_{(s)} + \tfrac{1}{2}\,O_2 + H_2O + 4NH_3 \quad E^\circ = -0.735 \text{ Volts Cell} \quad (10)$$

It has now been found possible to directly electrowin copper from ammoniacal solutions using a high surface area porous cathode and in the process produce almost cathode-grade copper from solutions which are normally contaminated with other metal values. In fact, very dilute leach solutions can be treated to win copper directly.

The process of the present invention comprises leaching a copper bearing material with a dilute ammoniacal solution to obtain a pregnant leach liquor containing from about 0.1 to 20 or more grams per liter (gpl) copper, clarifying the leach liquor and subjecting the pregnant leach liquor to an electrowinning process in which the leach liquor is preferably first contacted with a high surface area porous cathode electrode and then with an anode. The copper product is deposited on the cathode.

The copper product admixed with cathode material is removed from the electrolytic cell and treated to separate the copper. The copper-cathode material can be crushed and the crushed cathode material separated from the crushed cathode-copper material and the latter pyrometallurgically treated in a furnace in which the copper is melted and molten copper separated from crushed cathode material. The separated copper is of a high degree of purity, i.e., a purity approaching cathode grade copper, and the remaining crushed cathode material is suitable for reuse in a cathode. As an alternative to crushing and melting the copper from the copper admixed with the cathode material the copper may be directly electrorefined by using the cathode-copper product as an anode in a standard acid electrorefining process.

The barren leach liquor may be recycled to extract additional copper values from the copper bearing material being leached.

The present invention overcomes the disadvantages inherent in the prior art solvent extraction electrowinning and in the copper oxide precipitation-smelting processes.

Particular advantages of the present invention are that solubilized trace metal contaminants in the leach liquor do not interfere with the leaching of the copper by the ammoniacal leach liquor. The contaminants are not simultaneously electrowon with the copper from the contaminant containing pregnant ammoniacal leach liquor.

In accordance with the process described herein copper is electrowon from the pregnant leach solution at the cathode while oxygen is produced at the anode. Reactions (1), (2) and (3) are the major reactions with (5) occurring at a higher potential. In reaction (4) the $Cu_2O$ is unstable with respect to dissolution to $Cu(NH_3)_2^+$. Reaction (6) does not occur at a high rate in spite of the favorable potential. Current efficiencies for the production of copper exceed 80%.

BRIEF DESCRIPTION OF THE DRAWINGS

With references to the drawings, these illustrate the overall aspects of the process and the preferred embodiments thereof.

DETAILED DESCRIPTION OF THE INVENTION

Figure 1:
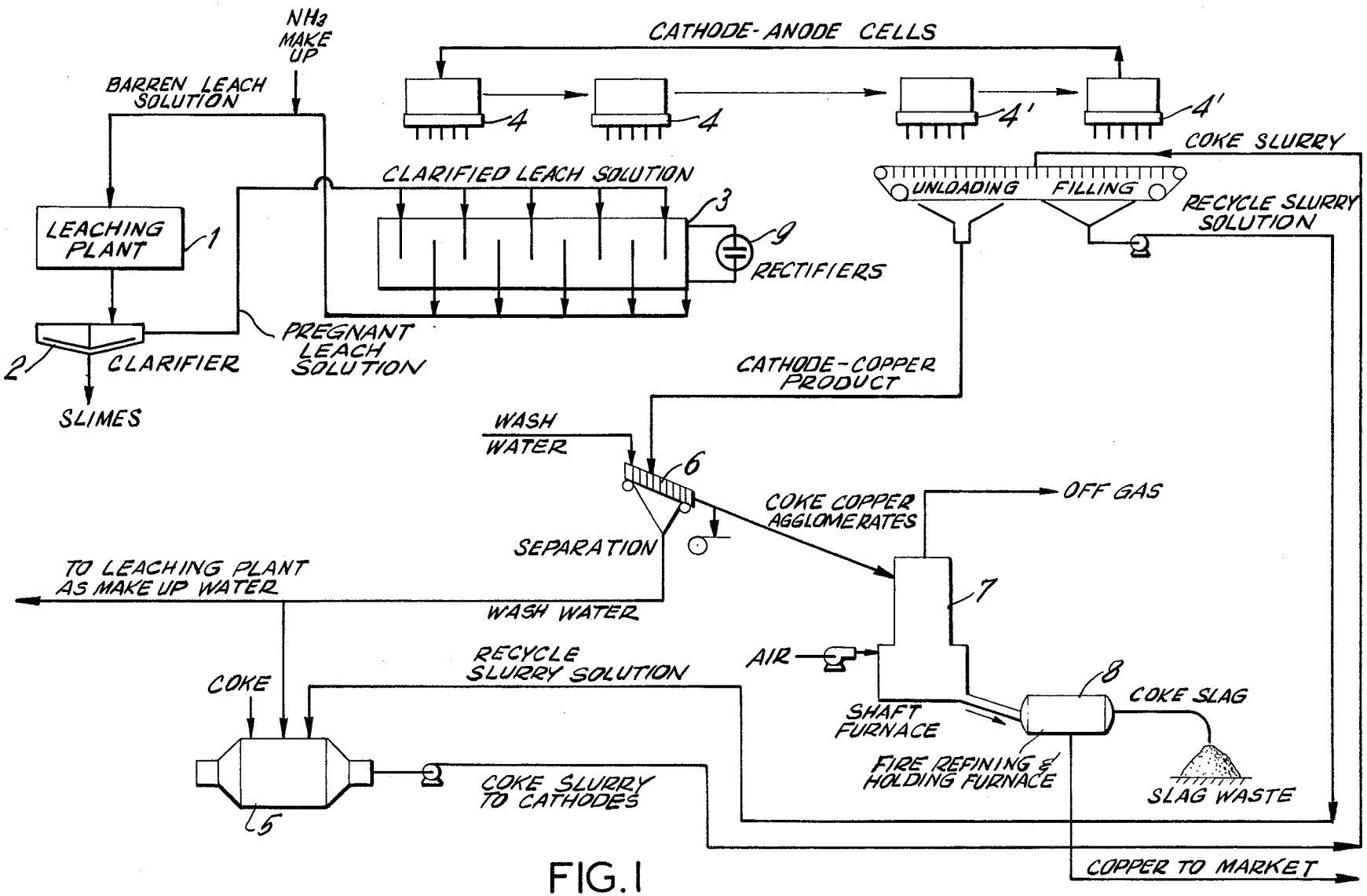
FIG. 1 illustrates an overall process flow sheet including leaching, electrowinning, recycling of barren leach liquor, the treatment of the cathode material and the pyrometallurgical recovery of copper product.

Suitable copper bearing materials to be treated in accordance with the present invention are native copper ores, copper containing wastes from mine dumps, copper composite by-products from other mining operations or processes, copper scrap and other copper containing materials. The copper ores can be mined and then treated or treated in-situ. The treated materials can contain from about 2 to 1970 lbs of copper per ton, and generally contain from about 5 to 1200 lbs. of copper per ton depending on the source of the material.

The leach solution contains 0.01 to 1.0 gpl copper and contains ammonia as the principal solubilizing agent by additions of 4 to 60 gpl as $NH_4$ and 2 to 30 gpl as $NH_3$.

The leach solution preferably contains less than 10% of the copper of the pregnant solution, 12 to 50 gpl $NH_4^+$ ion and 3 to 10 gpl dissolved $NH_3$.

The leach solution is contacted with the copper containing material in a conventional manner to selectively solubilize copper.

The pregnant leach solution from the leaching operation may contain 0.1 to 20.0 gpl or more copper, 4 to 60 gpl $NH_4^+$ and 2 to 30 gpl dissolved ammonia and minor amounts of dissolved metal contaminants. The pregnant leach solution preferably contains 0.5 to 10.0 gpl copper, 12 to 50 gpl $NH_4^+$ and 3 to 10 gpl dissolved ammonia.

The principal contaminants depend on the material being treated. The principal contaminants can be sodium, potassium, sulfur, calcium, zinc, molybdenum, nickel, silver, etc.

The alkalinity of the solution is maintained during the leach step between about pH 8 to pH 10 by the addition of gaseous ammonia. Preferably the alkalinity is maintained between about pH 8.5 to pH 9.5.

The alkalinity of the pregnant leach solution during the electrowinning step may be at any pH value above about 8. However, the preferred pH value for the direct electrowinning cell should be above about 8 pH and preferably above about 9 pH.

The cathode electrode is porous and has a high surface to volume ratio. Suitable electrodes have a true surface area of from about 2 to 1000 $cm^2/cm^3$. Preferred cathode electrodes have a surface area greater than about 60 $cm^2/cm^3$. The cathodes can be made from particulate coke material, carbon felt, graphite, lead wool, copper wool and shot. The void space can vary from about 25% (for close packing) to 97% (for carbon felt) depending on the form of the material and the method of packing. Generally, the void space varies from about 40% to 97%. The electrical conductivity can vary over a wide range depending on the cathode material selected. However, the electrical conductivity of the cathode should exceed that of the leach solution, i.e., electrolyte. A typical value for a coke bed is 0.10 to 0.50 $mho\text{-}cm^1$. A typical value for the leach solution is between about 0.01 to about 0.3 $mho\text{-}cm^1$.

A carbon felt with a porosity of 97% has been used successfully. A preferred material for the use in the preparation of the porous cathode electrode is coke in a particulate form.

The size of the coke is dependent upon the actual cathode structure used and may be from about minus 10 to about plus 100 mesh or smaller. The lower limit of the size of the particulate coke is determined by the ability of the cathode to contain the coke and the allowable hydraulic pressure drop through the cathode. Coke particles having a size in the range of about 4 to 100 mesh have been used to make suitable cathodes.

The anodes are not considered to be a limiting feature of the invention and serve primarily as a counter electrode to the cathode. Suitable anodes can be made from graphite, coke and steel.

The pregnant leach liquor is fed first to the cathode where the copper is deposited in and on the porous cathode material, flows to the anode and then flows out of the electrolytic cell. The flow rate in terms of gallons per minute (gpm) per square foot of cathode area can be from about 0.0001 to about 0.50 $gpm/ft^2$ and preferably about 0.0007 to about 0.08 $gpm/ft^2$ of cathode area and is determined in part by the concentration of copper in the feed solution.

The average effective current density can be 1 to 100 ASF and preferably from about 5 to about 40 ASF. The cell voltage can be 1 to 10 volts and preferably from about 1 to 4 volts. Copper is deposited in the cathode at a rate of about 0.0026 to 0.26 lbs. of copper per $ft.^2/hr.$ of cathode cross-section and preferably from about 0.013 to 0.1 lbs. of copper per $ft.^2/hr.$ of cathode cross-section area.

The electrolytic cell removes 20 to 99.9%, preferably over 90% of the copper present in the pregnant leach liquor in a single pass and the barren liquor is recycled to the leach step.

The leach step and the electrowinning step are carried out at ambient temperatures and ambient pressures. Though slightly higher or slightly lower temperatures and slightly higher or slightly lower pressures can also be used.

A preferred embodiment of the invention will be discussed in relation to FIG. 1 of the drawings showing a simplified flow sheet of the overall process. A barren, aqueous ammoniacal leach solution having a pH value of from about 8 to 10 and containing about 4 to 60 grams per liter of $NH_4^+$ and about 2 to 30 grams per liter of dissolved $NH_3$ enters leaching plant 1 where copper values are processed. The pH of the leach solution is maintained by the addition of make-up gaseous ammonia. The pregnant leach solution, which contains 0.5 to 6 grams per liter copper is clarified 2 prior to entering the electrowinning cell 3 at a rate of 1 to 20 gallons per hour per square foot of cathode area. Solution is distributed to each cathode electrode at a linear velocity of 0.1 to 1.8 feet per hour. Voltage is maintained across the cells between 3 and 7 volts, resulting in superficial current densities of 10 to 30 ASF.

The barren leach solution contains 0.02 to 0.5 gpl copper as it is withdrawn from the electrolytic cell. When sufficient copper has been deposited in and on the cathode 4, as determined by the pressure drop across cell 3, the cathode 4' containing the deposited copper is removed from the electrolytic cell 3 for treatment to recover the copper. Fresh coke material is substituted for the used coke material and cathode 4' with fresh coke cathode is returned to the electrolytic cell 3 for continuation of the process.

Coke for the cathode is prepared by grinding raw coke in a grinding mill 5, such as a rod mill in the presence of water. Fine coke particles are removed, by a means not shown, and a coke water slurry is pumped to the cathode cell 4'. The fresh coke in the slurry is substituted for used copper-coke product, the excess liquid drained and the drained liquid recycled to the grinding mill or used as make-up water. The cathode-anode cell is illustrated in greater detail in FIG. 3. The coke cathode has a high surface area and a high porosity.

When the cathode 4 in an operating cell has reached its capacity of deposited copper, it is unloaded, crushed and a coke portion separated from a copper-coke product portion is washed and the washed liquid separated from the copper-coke product, such as by separator 6. The copper-coke product, comprising about 25% by weight of the coke cathode, is fed to furnace 7 in which the copper is melted. Molten copper and coke slag are separated in fire refining and holding furnace 8. As illustrated in FIG. 1, the various legends amply explain the process sequence and conditions.

Figure 2:
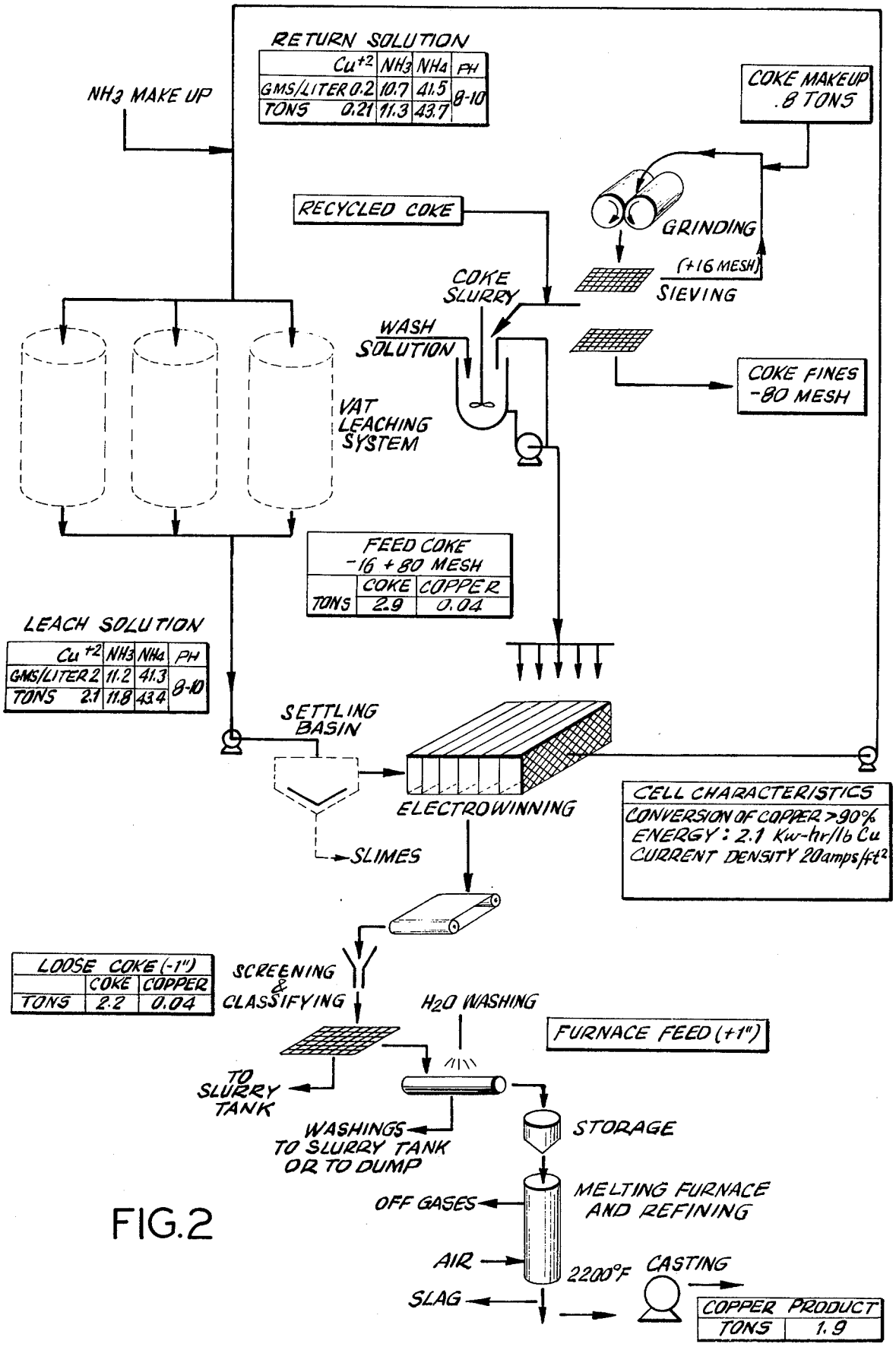
FIG. 2 illustrates a system for recovery of copper values from vat leaching.

FIG. 2 is illustrative of an embodiment of the invention in which a vat leach system provides a copper containing ammoniacal solution to the electrowinning cells and shows a simplified flow sheet with legends explaining the process sequence and the concentrations in the pregnant and barren leach solutions. Various copper bearing sources are amendable to ammoniacal vat leaching. These include oxide and native copper containing ores and waste products, oxidized sulfide ores, copper scrap and mixed metal scrap. The copper content of the source material is not specified in the legends, since economics rather than technology, at present, is the deciding factor in the utilization of this copper recovery system.

Figure 3:
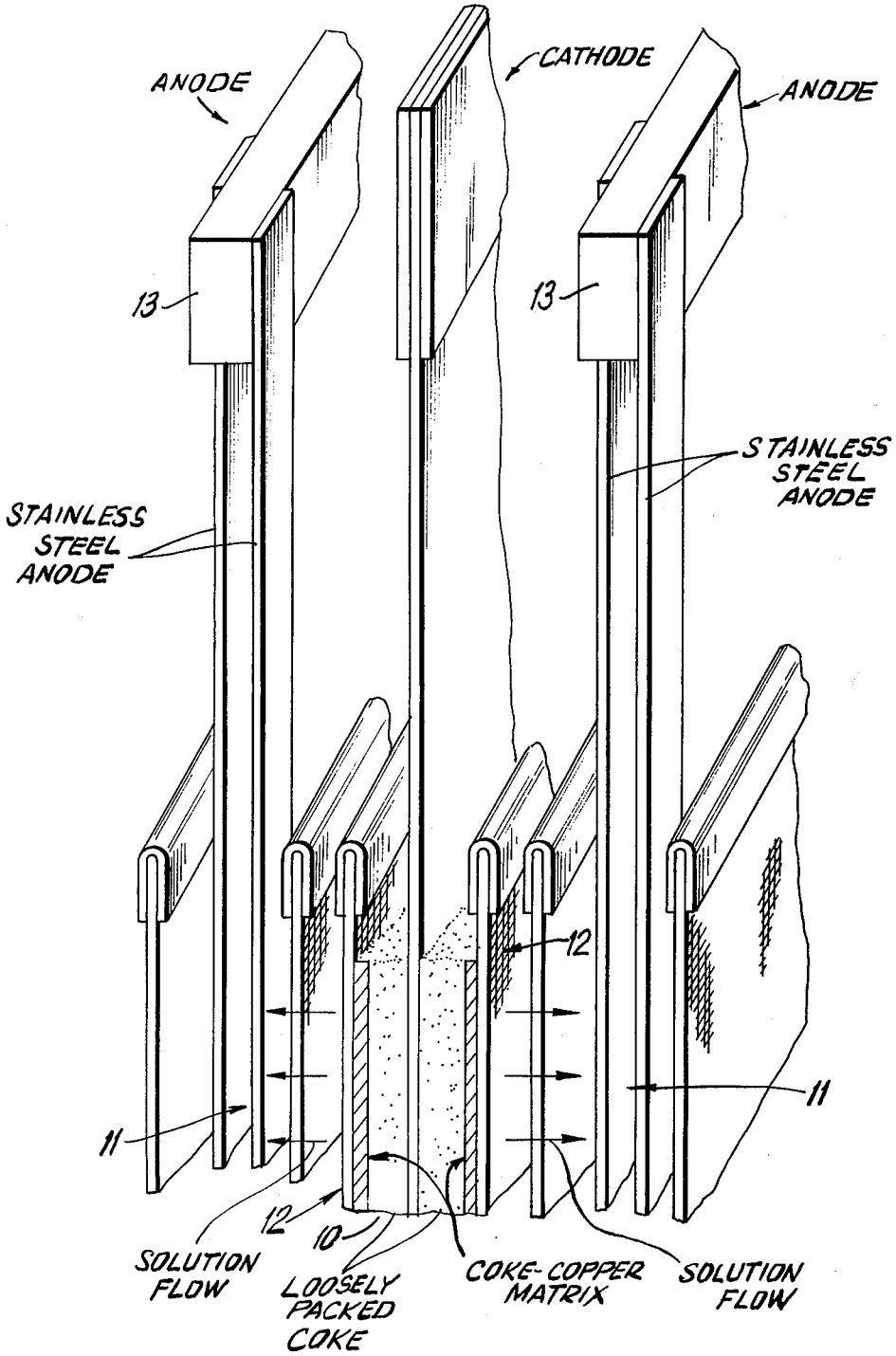
FIG. 3 illustrates in perspective an electrolytic cell that may be used in the present process.

FIG. 3 of the drawings illustrates in a fragmentary perspective view a cathode-anode electrolytic cell section and the direction of flow of liquid first through the cathode section 10 and then through the anode section 11. Retention screens 12 define the cathodic section. The retention screens 12 may be of teflon or polypropylene or other suitable material.

The cathodes in each cell are parallel and all cells are connected in series. The rectifiers 25 (See FIG. 1) used in converting AC to DC current are silicon diodes with adjustable voltage adaptability and constant current output. The busbars 30 are hard rolled copper rated at about 750 amps per square inch.

EXAMPLE

In order to illustrate the invention several runs were carried out using typical commercial ammoniacal leach solutions obtained from a test site. The compositions of the leach solutions were as follows:

PREGNANT SOLUTION

| Component | Concentration Range (gm/liter) |
|---|---|
| Cu | 0.40 – 2.20 |
| $NH_4$+ | 14.40 – 46.00 |
| $NH_3$ | 7.80 – 25.50 |
| Contaminants | |
| Zn | 0.00 – 0.70 |
| Mo | 0.00 – 0.16 |
| Ca | 0.30 – 0.90 |
| Mg | 0.04 – 0.06 |
| K | 0.07 – 0.75 |
| Na | 0.54 – 1.03 |
| $NO_3$ | 0.10 – 167.00 |
| $SO_4$ | 0.70 – 101.00 |
| Cl | 0.00 – 0.27 |

The alkalinity of the leach solution was between 8.8 pH and 9.2 pH. In the runs, the flow rates to the electrolytic cells were between 0.03 and 0.22 and 0.22 gpm ft.$^2$ of cathode cross-section. The current densities were between 7.0 to 23.4 ASF and the cell voltages were between 2.7 to 5.5 volts, while the current efficiencies varied between 27 to 83%. This resulted in an energy consumption of 1.5 to 4.7 kWh/lb. copper.

The specific operating conditions for each of the runs carried out are given in Table I below.

TABLE I

| RUN DESIGNATION | Cell Operating Data | | | | | | | | |
|---|---|---|---|---|---|---|---|---|---|
| | A | B | C | D | E | F | G | H | I |
| Flow Rate (gpm/ft$^2$) | 0.22 | 0.18 | 0.16 | 0.05 | 0.06 | 0.05 | 0.07 | 0.05 | 0.07 |
| Copper Conc. Feed (g/l) | 0.48 | 0.56 | 0.58 | 2.1 | 1.46 | 1.60 | 1.35 | .86 | 0.5 |
| Copper Conc. Effluent (g/l) | 0.15 | 0.11 | 0.15 | 0.07 | .66 | .63 | 0.08 | .46 | 0.15 |
| Copper Extraction (percent) | 69 | 80 | 74 | 97 | 55 | 61 | 94 | 46 | 70 |
| Cathode Area (ft$^2$) | 0.45 | 0.45 | 0.45 | 0.45 | 2.7 | 2.7 | 2.7 | 100 | 50 |
| Voltage, (Volts) | 5.4 | 3.8 | 3.8 | 3.3 | 3.7 | 4.5 | 3.3 | 3.3 | 3.5 |
| Current, (ASF) | 20 | 21 | 19.9 | 23.4 | 20.1 | 20.0 | 21.6 | 18 | 7 |
| Energy Consumption, (kWh/lb Cu recovered) | 3.0 | 2.0 | 2.2 | 1.5 | 3.1 | 3.7 | 1.6 | 4.7 | 2.0 |
| Current Efficiency (percent) | 70 | 74 | 66 | 83 | 45 | 47 | 79 | 27 | 67 |

The cathode coke material used in each of the runs was minus 10 to plus 50 mesh. In some of the runs fresh coke was used and in others the coke contained small amounts of copper. However, no appreciable differences in activity of the coke cathodes were noted.

The anode in each run was made from stainless steel.

A copper product melted from the coke obtained in runs G and H was fire refined and qualitatively analyzed to be greater than 99.8% copper and contained the trace impurities shown below in Table II.

TABLE II

| Run | oz/T | parts per million | | | | | | | | | |
|---|---|---|---|---|---|---|---|---|---|---|---|
| | Ag | S | O | Sn | Pb | Bi | Ni | Sb | Fe | As | Se |
| G | 1.2 | 12 | 2 | 1 | 1 | .5 | 40 | .5 | 16 | .3 | .5 |
| H | 4.0 | 8 | 350 | 0.2 | 1.7 | .05 | 33 | .03 | 6.0 | 2.6 | 6.0 |

Although various embodiments of the invention have been shown and described, the invention and its elements are defined by the following claims:

What we claim is:

1. A process for recovering copper from an ammoniacal copper solution containing about 0.1 to 20 gpl copper, 4 to 60 gpl $NH_4^+$ and 2 to 30 gpl $NH_3$ and having a pH of 8 to 10, which comprises a. introducing said solution into an electrolysis cell with a porous cathode material having a surface area of 2 to 1000 cm$^2$/cm$^3$ and an anode, b. applying a voltage of 1 to 10 volts across said cell such that the current density in said cathode is from about 1 to 100 ASF, c. flowing said solution through said cathode and by said anode at a rate to permit substantially complete reaction of the desired copper solute whereby copper is deposited in an on said cathode and a barren leach solution containing about 0.01 to 1.0 gpl copper is withdrawn, and d. recovering deposited copper from said cathode.

2. The process of claim 1 wherein said barren leach solution produced in step (c) is recycled to a leach system for the recovery of additional copper.

3. The process of claim 1 wherein the pH value of said solution is adjusted to a pH of about 8 to about 10 by the addition of ammonia.

4. The process of claim 1 wherein the cathode consists of coke and the copper is recovered from the cathodic material by melting the copper and separating the melted from the coke-cathode material.

5. The process of claim 1 wherein the copper is recovered from the cathodic material by direct electrorefining using the cathode-copper product as an anode in an electrolytic cell.

6. The process of claim 1 wherein the pH value of said solution is adjusted to pH 8 to pH 10 by the addition of ammonia to the solution prior to introduction of said solution into the electrolysis cell.

7. The process of claim 1 wherein the electrolysis cell cathode comprises a fine coke material of a size between −10 to 100 mesh.

8. The process of claim 1 wherein copper of about 99.8% purity is recovered.

9. The process of claim 7 wherein the copper is deposited on the coke cathode and a cathode-copper product is removed from the electrolysis cell and is crushed and separated into copper-free coke particles and copper-coke particles and the copper-free coke is recycled to prepare additional cathode and the copper-coke particles are treated to recover copper therefrom.

10. The process according to claim 1 wherein said solution is fed to the cathode cell at a rate of from about 0.0001 to 0.5 gpm/ft$^2$ of cathode cross-sectional area.

11. The process of claim 9 wherein less than about 25% by weight of the cathode-copper product is separated as copper-coke particles which are further treated to recover copper therefrom.

12. The process of claim 11 wherein the copper-coke particles are fed to a furnace, the copper melted and separated from the coke.

13. The process of claim 11 wherein the copper-coke particles are fed to an electrorefining process in which the copper-coke particles are used as an anode and the copper separated from the copper-coke particles.

14. A process for recovering copper from an ammoniacal copper solution containing 0.5 to about 6 gpl copper, 12 to 50 gpl $NH_4^+$ and 2 to 30 gpl $NH_3$ and having a pH of about 8 to 10, which comprises a. introducing said solution into an electrolysis cell with a cathode of porous coke cathodic material having a particle size of about 4 to 100 mesh and having a surface area of 2 to 1000 cm$^2$cm$^3$ and an anode, b. applying a voltage across said cell of about 1 to 4 volts such that the current density in said cathode is from about 5 to 40 ASF, c. flowing said solution through said cathode and by said anode at a rate to permit substantially complete reaction of the copper solute whereby over 90% of the copper in said solution is deposited in and on said cathode and a barren leach solution containing about 0.02 to 0.5 gpl copper is withdrawn from the electrolysis cell, and d. recovering deposited copper from said coke cathode.

15. The process of claim 14 wherein said barren leach solution produced in step (c) is recycled to a leach system for the recovery of additional copper.

16. The process of claim 14 wherein the copper is recovered from the coke cathode by melting the copper and separating the melted copper from the coke cathode.

17. The process of claim 14 wherein the copper is recovered fron the coke cathode by direct electrorefining using the coke cathode-copper product as an anode in an electrolytic cell.

* * * * *